US010875677B2

(12) United States Patent
Davis

(10) Patent No.: US 10,875,677 B2
(45) Date of Patent: Dec. 29, 2020

(54) TAMPER EVIDENT CONTAINER

(71) Applicant: Multi Packaging Solutions UK Limited, Nottingham (GB)

(72) Inventor: Nigel Davis, Nottingham (GB)

(73) Assignee: MULTI PACKAGING SOLUTIONS UK LIMITED, Nottingham (GB)

( * ) Notice: Subject to any disclaimer, the term of this patent is extended or adjusted under 35 U.S.C. 154(b) by 0 days.

(21) Appl. No.: 16/394,022

(22) Filed: Apr. 25, 2019

(65) Prior Publication Data

US 2019/0329930 A1 Oct. 31, 2019

(30) Foreign Application Priority Data

Apr. 27, 2018 (GB) ..... 1806942.7
Feb. 18, 2019 (GB) ..... 1902207.8

(51) Int. Cl.
*B65D 5/10* (2006.01)
*B65D 5/66* (2006.01)
(Continued)

(52) U.S. Cl.
CPC ..... *B65D 5/106* (2013.01); *B65D 5/0227* (2013.01); *B65D 5/4266* (2013.01); *B65D 5/665* (2013.01); *B65D 2401/15* (2020.05)

(58) Field of Classification Search
CPC ..... B65D 5/0254; B65D 5/0024; B65D 5/103–106; B65D 5/701; B65D 5/6608;
(Continued)

(56) References Cited

U.S. PATENT DOCUMENTS 4,830,270 A * 5/1989 Holmes ..... B65D 5/0254 206/807
5,350,108 A * 9/1994 Friar ..... B65D 5/6608 229/102
(Continued)

FOREIGN PATENT DOCUMENTS

DE 9306900 U1 7/1993
DE 602004007700 4/2008
(Continued)

OTHER PUBLICATIONS

Machine Translation of WO 2012/048671 A2 (Year: 2012).*
(Continued)

*Primary Examiner* — Nathan J Newhouse
*Assistant Examiner* — Phillip D Schmidt
(74) *Attorney, Agent, or Firm* — The Dobrusin Law Firm, P.C.; Bryan S. Lemanski

(57) ABSTRACT

A tamper evident container (2) made from cardboard, paperboard or other lightweight foldable sheet material comprises a container body (6) comprising a first pair of opposed side wall panels (8, 10) and a second pair of side wall panels (12, 14), the side wall panels (8, 10, 12, 14) being hingedly attached to each other about respective side wall fold lines (16). A lid (22) is hingedly attached to one side wall panel (8) of the first pair of opposed side wall panels (8, 10) about a lid fold line (26). First and second closure flaps (28, 30), are hingedly attached to a respective one of the second pair of opposed wall panels (12, 14) about respective closure flap fold lines (32, 34) so as to define respective locking slots (36, 38) between a side edge of the respective closure flaps (28, 30) and the other side wall panel (10) of the first pair of side wall panels (8, 10). The lid (22) comprises a lid panel (50) hingedly attached at a proximal edge (52) to the one side wall panel (8) of the first pair of side wall panels (8, 10) about the lid fold line (26). It further comprises a locking
(Continued)

flap (56) comprising a first locking flap panel (58) hingedly attached at a proximal edge (60) to a distal edge (62) of the lid panel (50) about a frangible line of weakness (64) and a second locking flap panel (66) hingedly attached at a proximal edge (68) to a distal edge (70) of the first locking flap panel (58) about a locking flap fold line (72). It is folded about the locking flap fold line (72) so as to lie behind and in a face to face relationship with the first locking flap panel (58). A distal end (74) of the second locking flap panel (66) comprises at least one free edge forming a locking edge (76). The locking flap (56) is insertable into the locking slots (36, 38) such that the at least one locking edge (76) of the second locking flap panel (66) engages behind the side edges of the closure flaps (36, 38) so as to lock the lid (22) in position.

16 Claims, 15 Drawing Sheets

(51) Int. Cl.
*B65D 5/02* (2006.01)
*B65D 5/42* (2006.01)

(58) Field of Classification Search
CPC .. B65D 5/6635; B65D 5/6644; B65D 5/6655; B65D 2101/0023
USPC ..... 229/102, 132, 151–153; 206/807
See application file for complete search history.

(56) References Cited

U.S. PATENT DOCUMENTS

| | | | | |
|---|---|---|---|---|
| 2004/0069659 | A1 * | 4/2004 | Sutherland | B65D 71/20 206/140 |
| 2005/0173291 | A1 * | 8/2005 | Specker | B65D 5/2009 206/536 |
| 2005/0199692 | A1 | 9/2005 | Nelson | |
| 2017/0297802 | A1 * | 10/2017 | Davis | B65D 43/16 |

FOREIGN PATENT DOCUMENTS

| | | | | |
|---|---|---|---|---|
| DE | 202010014299 | U1 | 12/2010 | |
| GB | 823278 | A * | 11/1959 | B65D 5/106 |
| GB | 1238176 | A | 7/1971 | |
| JP | 2010184713 | A | 8/2010 | |
| WO | WO-2012048671 | A2 * | 4/2012 | B65D 5/541 |

OTHER PUBLICATIONS

Search Report dated Nov. 7, 2018, Application No. GB1806942.7.
Extended European Search Report dated Aug. 7, 2019, Application No. 19171054.0.

* cited by examiner

TAMPER EVIDENT CONTAINER

TECHNICAL FIELD

The present invention relates to tamper evident containers made of cardboard, paperboard or other flexible sheet materials.

BACKGROUND

There is a growing need for containers, for example containers containing pharmaceutical products, to provide evidence that the container may have been opened so as to prevent a malicious third party opening the container and potentially tampering with its contents after the container has been filled and before it is purchased or obtained by an end user.

The present invention provides a container of this type.

SUMMARY

From one aspect, the invention may provide a tamper evident container made from cardboard, paperboard or other lightweight foldable sheet material. The container comprises a container body, a lid, and first and second closure flaps. The container body comprises a first pair of opposed side wall panels and a second pair of side wall panels. The side wall panels are hingedly attached to each other about respective side wall fold lines. The lid is hingedly attached to one side wall panel of the first pair of opposed side wall panels about a lid fold line. The first and second closure flaps are each hingedly attached to a respective one of the second pair of opposed wall panels about respective closure flap fold lines so as to define respective locking slots between a side edge of the respective closure flaps and the other side wall panel of the first pair of side wall panels. The lid comprises a lid panel and a locking flap. The lid panel is hingedly attached at a proximal edge to the one side wall panel of the first pair of side wall panels about the lid fold line. The locking flap includes a first locking flap panel hingedly attached at a proximal edge to a distal edge of the lid panel about a frangible line of weakness and a second locking flap panel is hingedly attached at a proximal edge to a distal edge of the first locking flap panel about a locking flap fold line and folded about the locking flap fold line so as to lie behind and in a face to face relationship with the first locking flap panel. A distal end of the second locking flap panel comprises at least one free edge forming a locking edge. The locking flap is insertable into the locking slots such that the at least one locking edge of the second locking flap panel engages behind the side edges of the closure flaps so as to lock the lid in position.

The second locking flap panel may be adhesively attached to the first locking flap panel to prevent the second locking flap unfolding relative thereto.

The second locking flap panel may be adhered to the first locking flap panel through an adhesive tab.

In some embodiments, the second locking flap panel may comprise a pair of cut lines which extend to the distal edge of the second locking flap panel so as to define the adhesive tab therebetween, and a pair of locking edges on the distal edge on either side of the adhesive tab. The adhesive tab may be formed in a central region of the distal edge of the second locking flap panel.

In other embodiments, the adhesive tab may be defined in the second locking flap at a spacing from the distal edge.

In yet other embodiments, the adhesive tab may be hingedly attached to the distal edge of the second closure flap panel about an adhesive tab fold line, the adhesive tab being sandwiched between the first and second closure flap panels and adhered at least to the first closure flap panel. The adhesive tab may extend across only a portion of the distal edge of the second closure flap panel.

In accordance with the invention in any of its aspects or embodiments, the side edges of the closure flaps may be ramped so as to define the locking slots with the other side wall panel of the first pair of side wall panels only at a proximal end region of the closure flaps thereof adjacent the respective side wall panel.

The frangible line of weakness may comprise perforations.

The frangible line of weakness may comprise a partial thickness cut.

The container may further comprise an opening tab defined in the lid panel at the frangible line of weakness, and interrupting the line of weakness.

The container may further comprise a refastenable re-closure arrangement that includes cooperating parts associated with each of the first and second closure flaps for releasably interlocking the first and second closure flaps together.

In some embodiments, the cooperating parts may include a locking tab associated with one of the first and second closure flaps and an opening associated with the other of the first and second closure flaps. The opening may be configured to receive the locking tab for releasably interlocking the first and second closure flaps together. The container may further include a re-closure panel hingedly attached along a fold line to a distal edge of the one of the first and second closure flaps having the locking tab associated therewith, wherein the locking tab interrupts the foldline. The locking tab may be formed by a cutline which extends from the re-closure panel across the foldline into the one of the first and second closure flaps.

In other embodiments, a pair of stubs may be defined on either side of the locking tab between the edge of the locking tab and the portion of the foldline on the respective side of the locking tab. The stubs may have rounded ends.

From another aspect, the invention provides a blank made from cardboard, paperboard or other lightweight foldable sheet material for a tamper evident container. The blank comprises: a first pair of opposed side wall panels and a second pair of side wall panels, the side wall panels being hingedly attached to each other about respective side wall fold lines; a series of joined panels hingedly attached to one side wall panel of the first pair of opposed side wall panels about a lid fold line; first and second closure flap panels, each hingedly attached to a respective one of the second pair of opposed wall panels about respective closure flap fold lines for defining respective locking slots between a side edge of the respective closure flap panels and the other side wall of the first pair of side wall panels when the container is erected. The series of joined panels comprises a lid panel, a first locking flap panel and a second locking flap panel. The lid panel is hingedly attached at a proximal edge to the one side wall panel of the first pair of side wall panels about the lid fold line. The first locking flap panel is hingedly attached at a proximal edge to a distal edge of the lid panel about a frangible line of weakness. The second locking flap panel is hingedly attached at a proximal edge to a distal edge of the first locking flap panel about a locking flap fold line and foldable about the locking flap fold line so as to lie behind and in a face to face relationship with the first locking flap panel. A distal end of the second locking flap panel includes at least one free edge forming a locking edge.

The blank may further comprise an adhesive tab.

In some embodiments, the second locking flap panel may comprise a pair of cut lines which extend to the distal edge of the second locking flap panel so as to define the adhesive tab therebetween, and a pair of locking edges on the distal edge on either side of the adhesive tab. The adhesive tab may be formed in a central region of the distal edge of the second locking flap panel.

In other embodiments, the adhesive tab may be defined in the second locking flap at a spacing from the distal edge.

In yet other embodiments, the adhesive tab may be hingedly attached to the distal edge of the second closure flap panel about an adhesive tab fold line. The adhesive tab may extend across only a portion of the distal edge of the second closure flap panel.

In accordance with the invention in any of its aspects or embodiments, the side edges of the closure flaps may be ramped.

The frangible line of weakness may comprise perforations.

The frangible line of weakness may comprise a partial thickness cut.

The blank may further comprise an opening tab defined in the lid panel at the frangible line of weakness, and interrupting the line of weakness.

DETAILED DESCRIPTION

Figure 1:
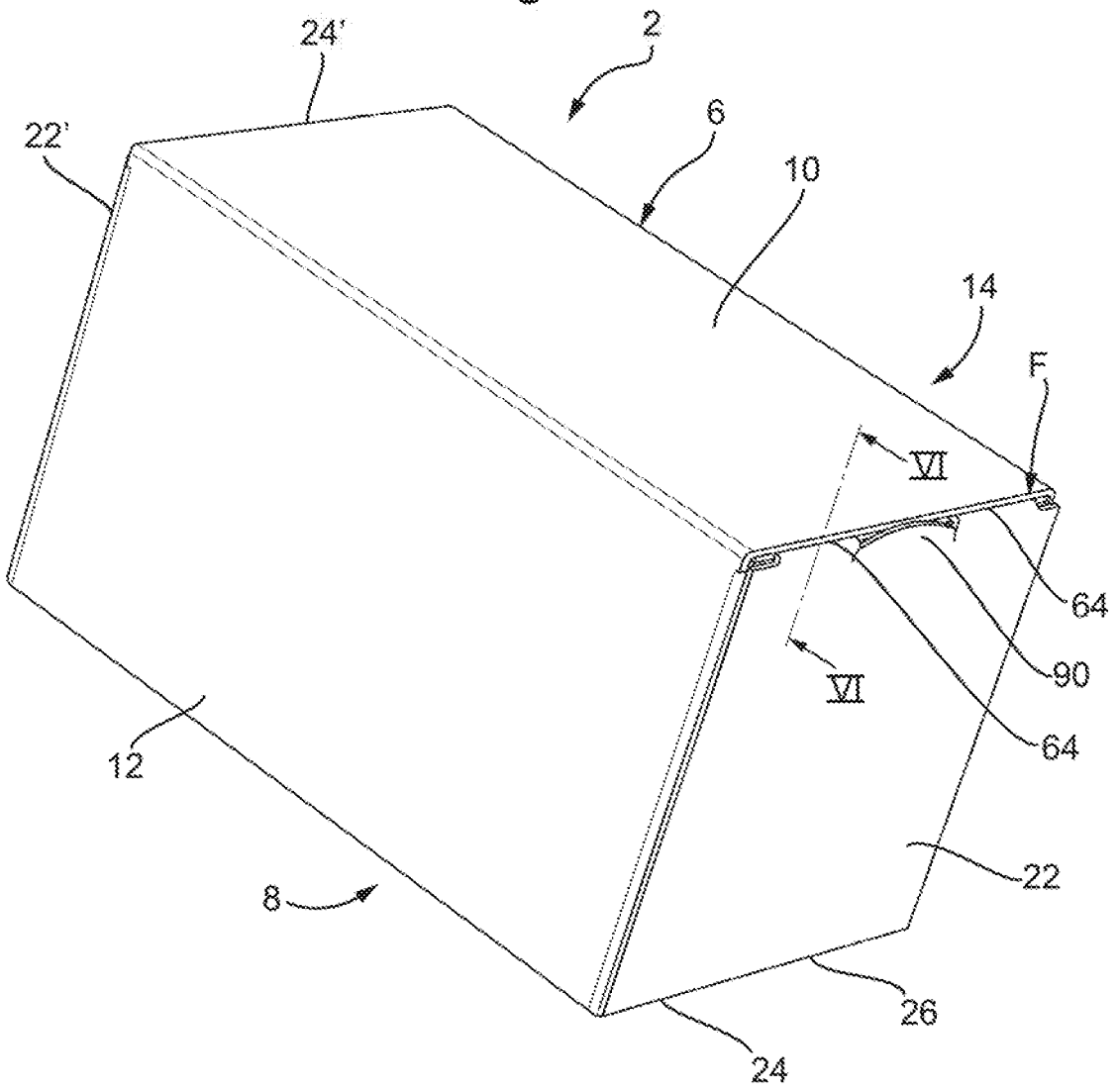
FIG. 1 shows a perspective view of a first embodiment of container in accordance with the present invention.
Figure 2:
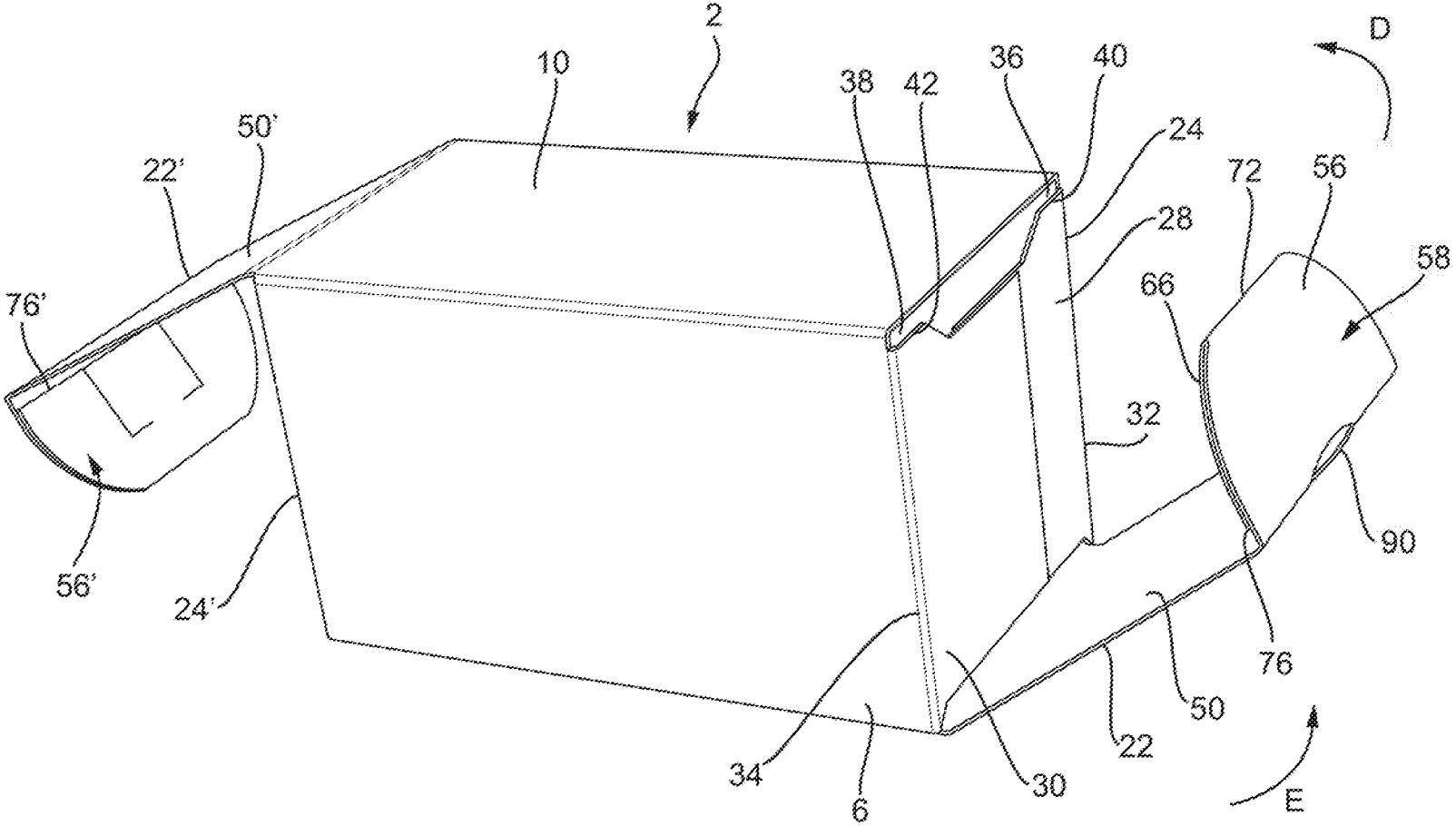
FIG. 2 shows the container of FIG. 1 in a partially erected condition.
Figure 3:
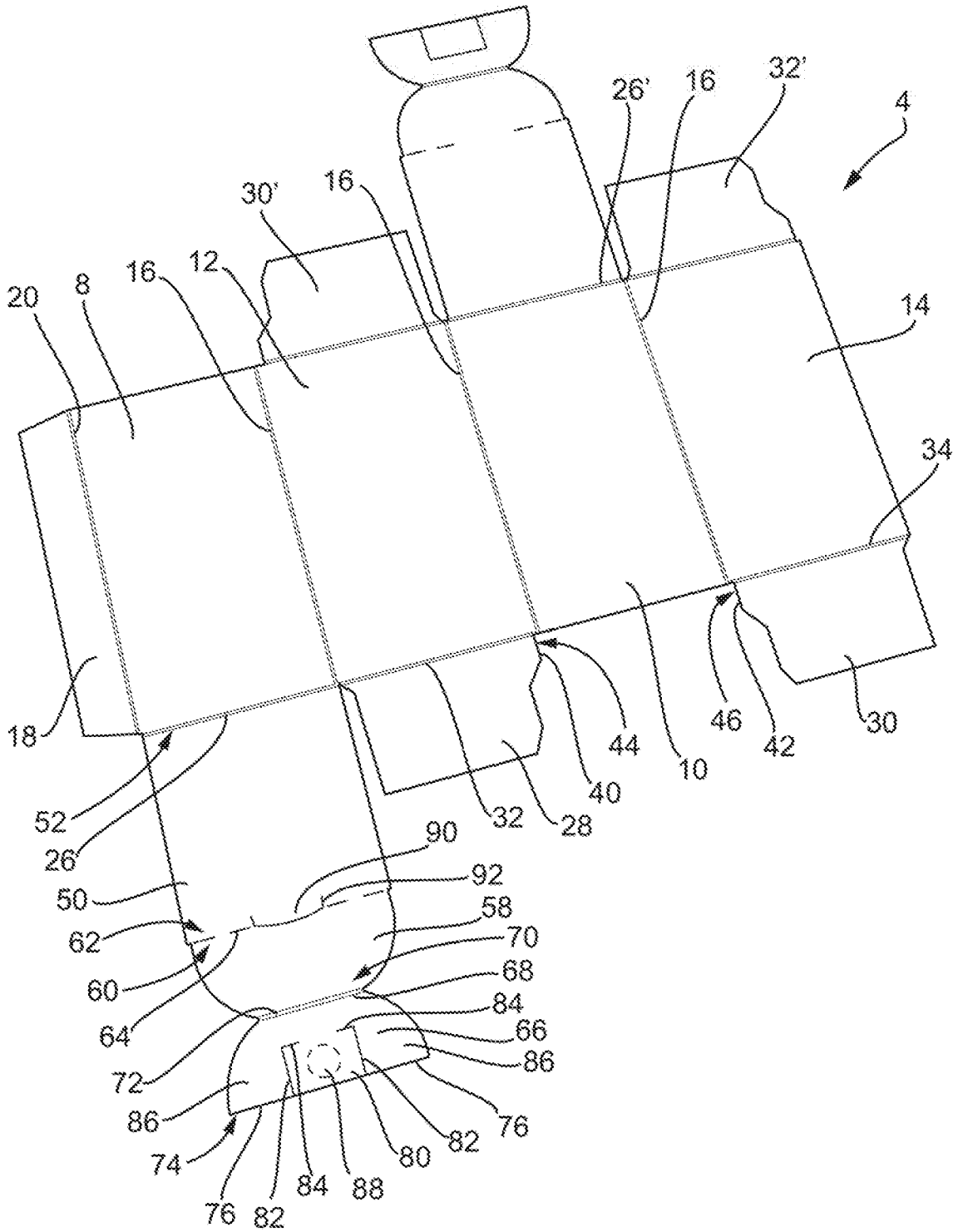
FIG. 3 shows a blank for making the container of FIG. 1.

With reference to FIGS. 1 to 6, a first embodiment of tamper evident container 2 in accordance with the invention is illustrated. The container 2 is made from a foldable sheet material such as paperboard, cardboard or even a plastics material. The particular material and its thickness will depend upon the particular application for the container 2. The container 2 is erected from a foldable blank 4 which is illustrated in FIG. 3.

The container 2 comprises a container body 6 comprising a first pair of opposed side wall panels 8, 10 and a second pair of opposed side wall panels 12, 14. The side wall panels 8, 10, 12, 14 are hingedly attached to each about respective side wall fold lines 16. A glue tab 18 is hingedly connected to a first panel 8 of the first pair of opposed side wall panels 8, 10 about a further hinge line 20.

The container 2 further comprises a lid 22, 22' at opposed ends 24, 24' of the container body 6. A first lid 22 is hingedly attached to the first panel 8 of the first pair of opposed side wall panels 8, 10 about a first lid fold line 26. A second lid 22' is hingedly attached to the second panel 10 of the first pair of opposed side wall panels 8, 10 about a second lid fold line 26'. The construction and assembly of the first and second lids 22, 22' is the same, so only the construction and assembly of the first lid 22 will be described in detail below.

The container 2 further comprises first and second closure flaps 28, 30, 28', 30' at the respective ends 24, 24' of the container body 6. As the construction and arrangement of the closure flaps at either end of the container body 6 is the same, only the details of the closure flaps 28, 30 at end 24 will be described in detail below.

The first and second closure flaps 28, 30 at end 24 are hingedly attached to a respective one of the second pair of opposed wall panels 12, 14 about respective closure flap fold lines 32, 34 so as to define, when erected, respective locking slots 36, 38 between a respective side edge 40, 42 of the respective closure flaps 28, 30 and the other side wall panel 10 of the first pair of side wall panels 8, 10. The locking slots 36, 38 can be seen most clearly in FIG. 2. It will be seen that the side edge 40 of each of the first and second closure flaps 28, 30 is ramped such that the locking slot 36, 38 is only formed with the side wall panel 10 adjacent the respective closure flap fold line 32, 34. The length of the locking slot 36, 38 can be modified by lengthening or shortening the proximal portion 44, 46 of the side edge 40, 42 as necessary.

Returning now to the lid construction, the first lid 22 comprises a lid panel 50 which is hingedly attached at a proximal edge 52 to the one panel 8 of the first pair of side wall panels 8, 10 about the lid fold line 26. The lid 22 further comprises a locking flap 56.

The locking flap 56 comprises a first locking flap panel 58 hingedly attached at a proximal edge 60 to a distal edge 62 of the lid panel 50 about a frangible line of weakness 64. In this embodiment, the frangible line of weakness 64 is illustrated as a perforation or line of cuts. In other embodiments, however, the line of weakness 64 may be formed as a partial cut through the depth of the panel material. The partial cut may be made from the side of the panel which will be outermost in use.

The locking flap 56 further comprises a second locking flap panel 66 which is hingedly attached at a proximal edge 68 to a distal edge 70 of the first locking flap panel 58 about a locking flap fold line 72. As can be seen for example in FIGS. 2 and 5, when erected, the second locking flap panel 66 is folded inwardly about the locking flap fold line 72 so as to lie behind and in a face to face relationship with the first locking flap panel 58.

The distal edge 74 of the second locking flap panel 66 comprises at least one free edge portion 76 for forming a locking edge. As will be described further below, the locking flap 56 is insertable into the locking slots 36, 38 such that the at least one locking edge 76 of the second locking flap panel 66 engages behind the proximal portions of the closure flaps 28, 30 so as to lock the lid 22 in position.

As discussed above, the second locking flap panel 66 is folded behind the first locking flap panel 58 and hingedly attached thereto about the locking flap fold line 72. However, the second locking flap panel 66 is also adhered to the first locking flap panel 58 adhesively.

In this embodiment, the second locking flap panel 66 is adhered to the first locking flap panel 58 through a tab 80 which is defined in the second locking flap panel 66 between a pair of cut lines 82 which extend to the distal edge 74 thereof. In this embodiment, the cut lines 82 are L-shaped, the portions 84 of the cut lines 82 extending parallel to the distal edge 74 allows the a side portions 86 of the second locking flap panel 66 arranged to either side of the tab 80 to flex more easily away from the first locking flap panel 50 due to the folding of the second locking flap panel 66 around the locking flap fold line 68, thereby spacing the locking edges 76, which are formed on those side regions 86 on either side of the adhesive tab 80, to be spaced from the underlying regions of the first locking flap panel 50, thereby improving the locking into engagement with the locking slots 36, 38. This can be seen, for example, in FIG. 6.

The adhesive tab 80 may be adhesively attached to the first locking flap panel 58 at an adhesive location 88. An adhesive, such as a hot melt adhesive or a water-based adhesive may be applied to the adhesive location during direction of the container 2. It will be understood that the adhesive attachment of the second locking flap panel 66 to the first locking flap panel 58 will prevent the second locking flap panel 66 simply unfolding relative to the first locking flap panel 58.

In this embodiment, the adhesive tab 80 is formed in a central region of the distal edge 74 of the second locking flap panel 68.

It can also be seen, for example from FIGS. 1, 2 and 3 that an opening tab 90 is provided in the lid 22. The opening tab 90 projects from the lid panel 50 and is formed by a cut line 92 which extends from the lid panel 50 across the frangible line of weakness 64 into the first locking flap panel 58. The cut line 92 therefore interrupts the frangible line of weakness 64. As can be seen in FIG. 1, the opening tab 90 will allow a user to insert his or her fingernail behind the tab so as to pull open the lid 22.

Having defined the construction of the container 2, its erection will now be described with reference to FIGS. 3 to 6.

Figure 4:
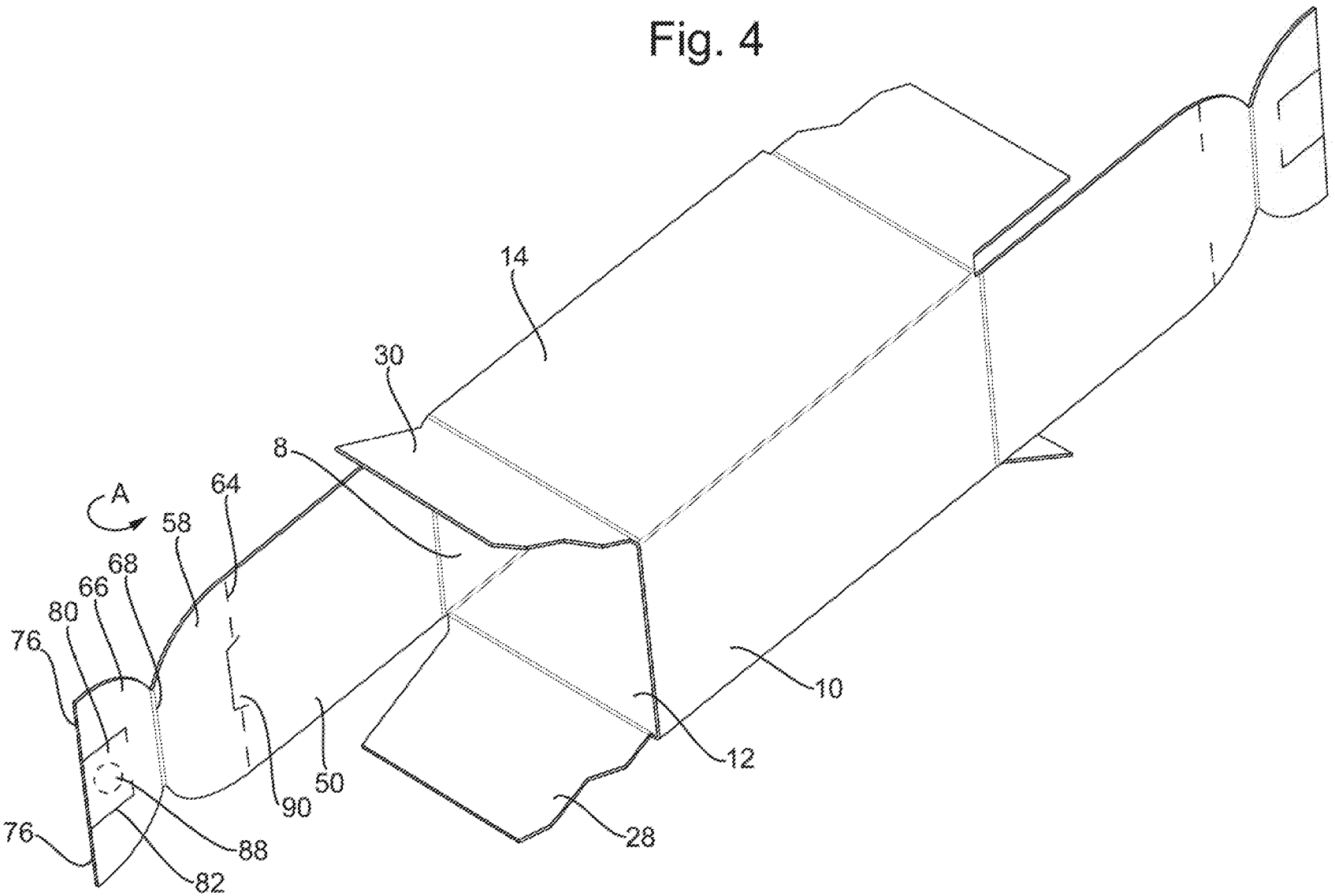
FIG. 4 shows an intermediate stage in the erection of the container of FIG. 1.

FIG. 3 shows the blank 4 for making the container. In a first step, the side wall panels 8, 10, 12, 14 may be folded around the sidewall hinge lines 16 and the container erected into a tubular configuration by gluing the glue tab 18 in position. This stage is illustrated in FIG. 4.

Figure 5:
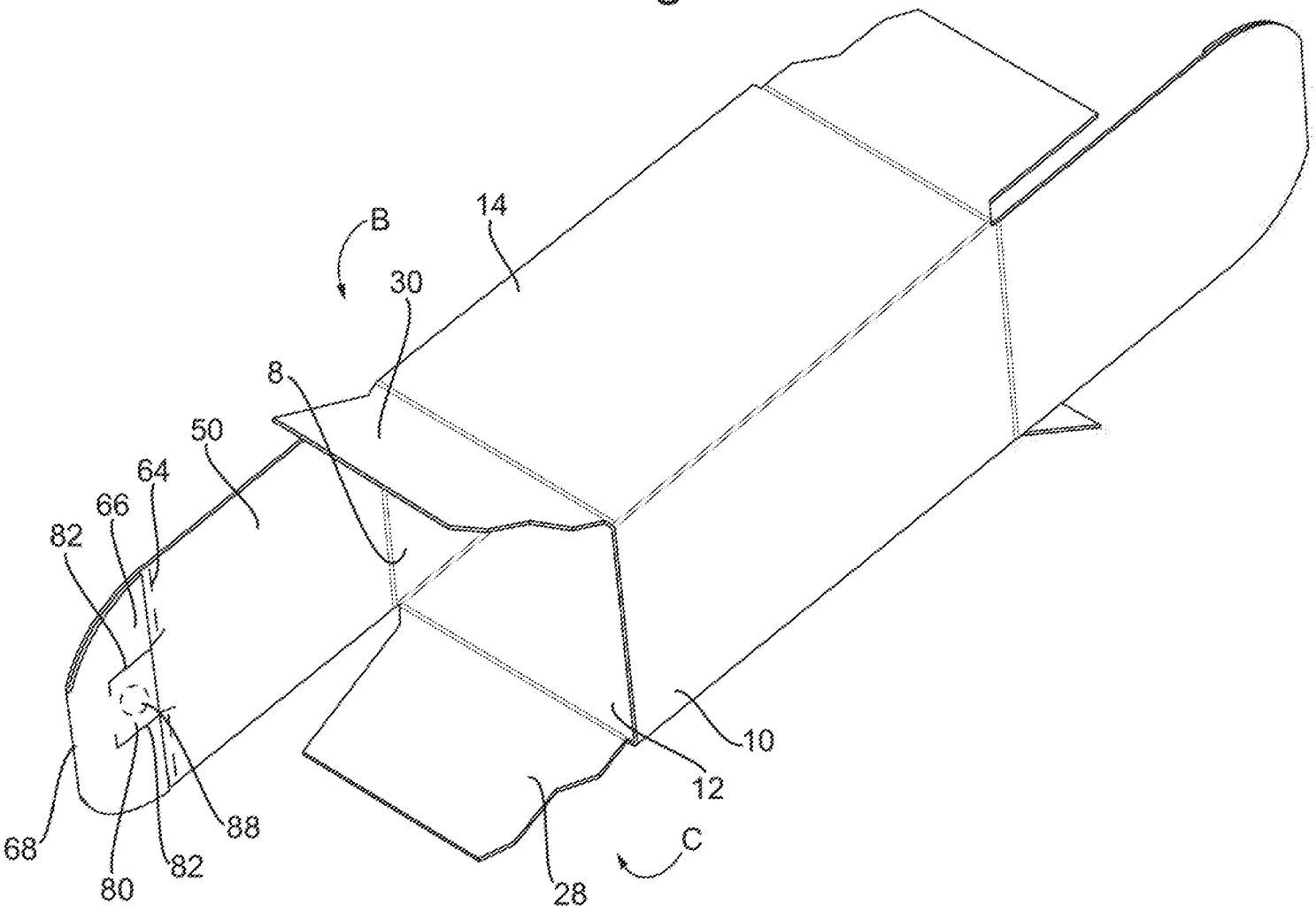
FIG. 5 shows a further stage in the erection of the container of FIG. 1.
Figure 7:
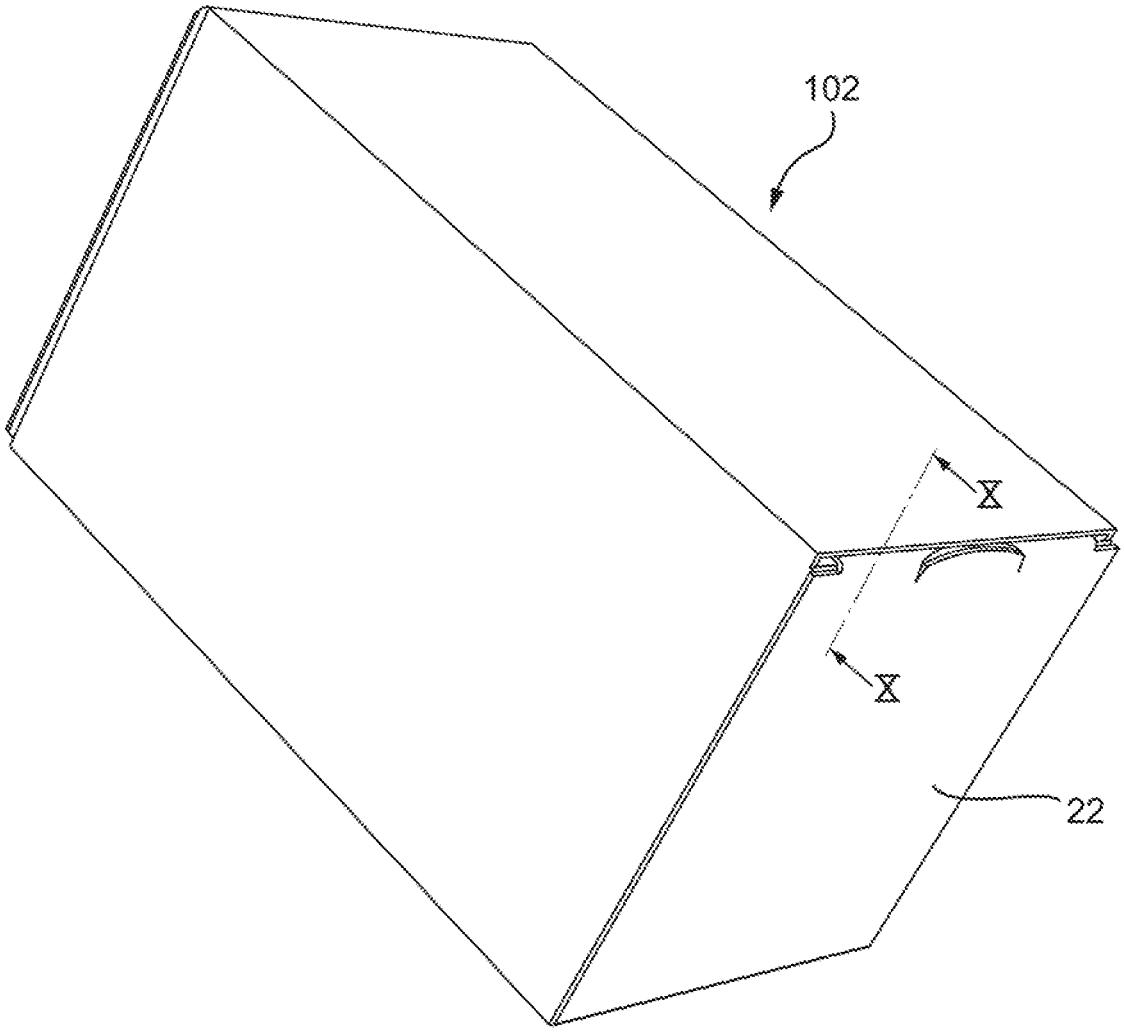
FIG. 7 shows a perspective view of a second embodiment of container in accordance with the present invention.
Figure 10:
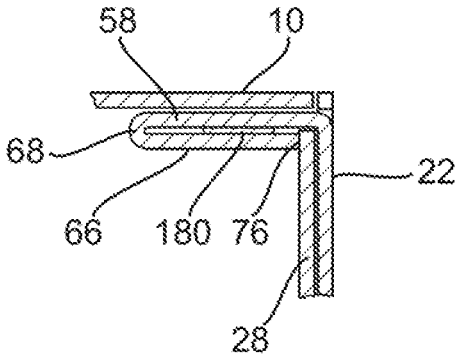
FIG. 10 shows a sectional view along line X-X of FIG. 7.
Figure 8:
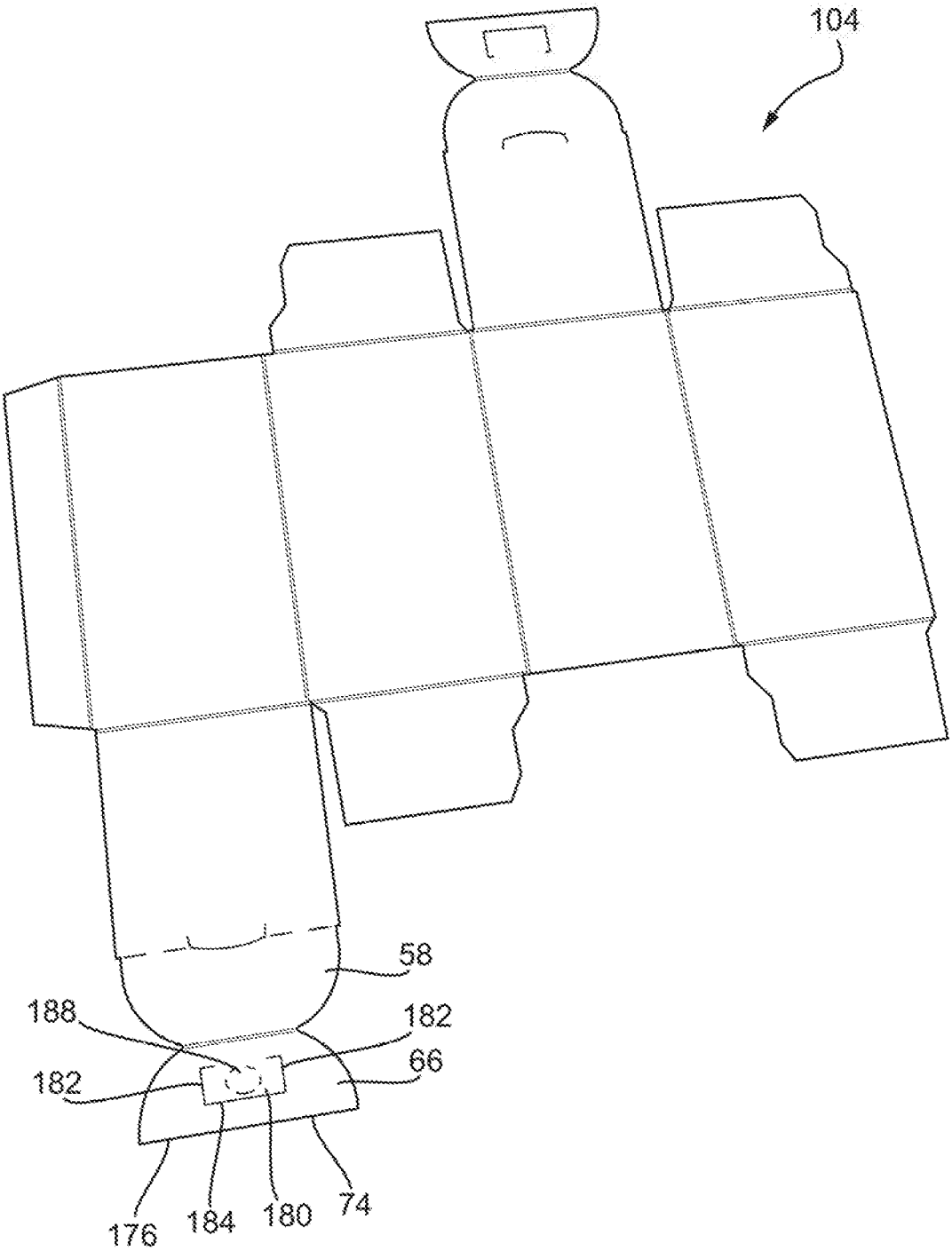
FIG. 8 shows a blank for making the container of FIG. 7.
Figure 9:
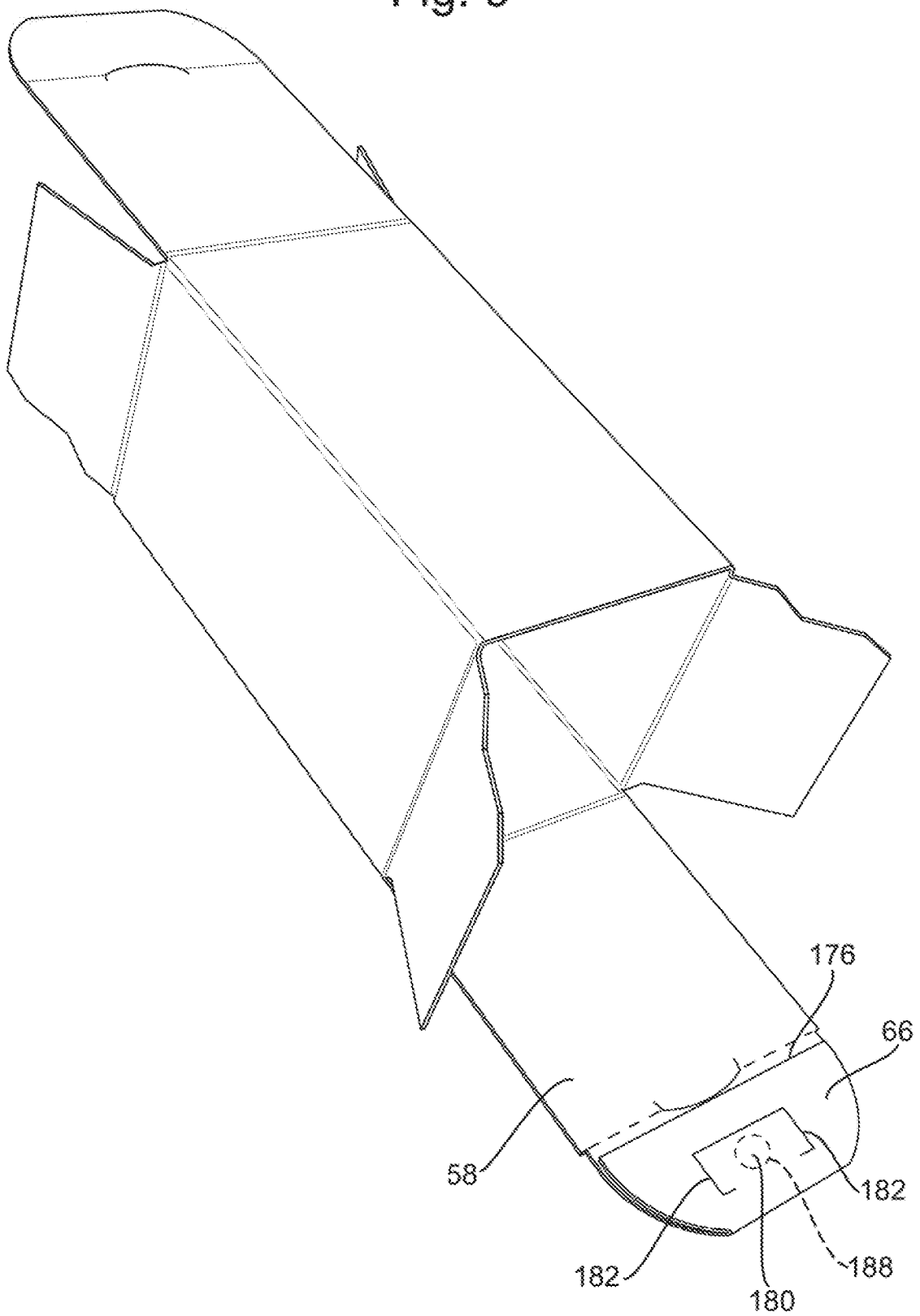
FIG. 9 shows an intermediate stage in the erection of the container of FIG. 7.
Figure 11:
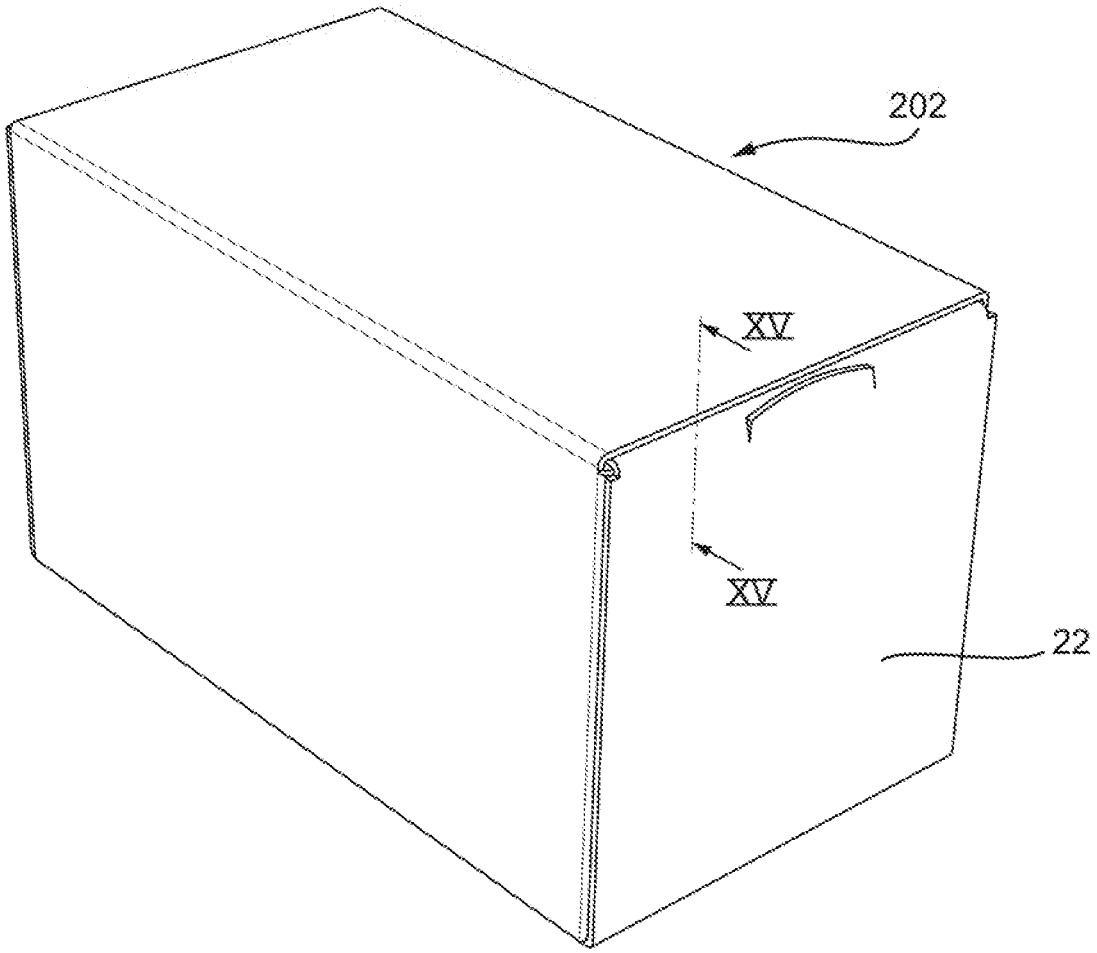
FIG. 11 shows a perspective view of a third embodiment of container in accordance with the present invention.

Next, an adhesive may be applied to the adhesive region 88 of the adhesive tab 80 in the second locking flap panel 66 and the second locking flap panel 66 then folded inwardly along the locking flap fold line 68 about in a direction A such that the second locking flap panel 66 lies behind and in a face-to-face relationship with the first locking flap panel 58. The adhesive tab 80 is adhesively secured to the inner surface of the first locking panel flap 58 at the adhesive region 88. This position is shown in FIG. 5. The closure flaps 28, 30 can then be folded inwardly in directions B and C as shown in FIG. 5 such that they substantially close the end 24 of the container body 6. The proximal regions of the closure flaps 28, 30 form the locking slot 36, 38 with the sidewall 10 of the container body as shown in FIG. 2.

Figure 6:
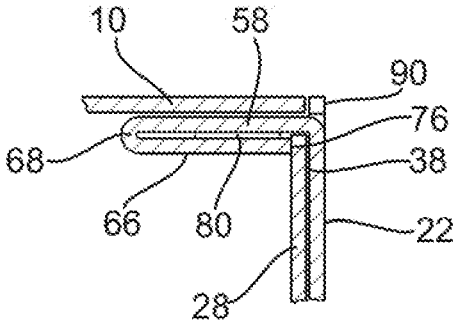
FIG. 6 shows a sectional view along line VI-VI of FIG. 1.

The locking flap 56 may then be rotated in a direction D about the frangible line of weakness 64 and the lid 22 rotated about the lid hinge line 26 in a direction E (as shown in FIG. 2) such that the locking flap 56 enters the container body through the locking slots 36, 38. As shown in FIG. 6, the locking edges 76 of the second locking flap panel 66 lift away somewhat from the first locking flap panel 58 so as to lie behind the respective closure flaps 28, 30. This locks the lid 22 in position.

When a user wishes to open the container 2, he or she inserts a fingernail behind the opening tab 90 and pulls the lid 22 in a direction F shown in FIG. 1. This rotates the lid 22 about the lid fold line 26. The locking edge 76 of the second locking flap panel 66 prevents this rotation until such time as the frangible line of weakness 64 which connects the lid 22 to the container body 6 breaks, separating the locking flap 56 from the lid panel 50. A user may then gain access to the contents of the container 2. The adhesive attachment of the second locking flap panel 66 to the first locking flap panel 58 will prevent the second locking flap panel 66 simply unfolding relative to the first locking flap panel 58 during opening of the container 2, which might permit opening of the container 2 without breaking the frangible connection 64.

This provides a tamper evident feature since it is not possible for the user properly to close the lid 22 again, as there is no locking flap 56.

This describes the closure of just one end of the container. The closure of the other end of the container 2 occurs in a similar manner.

FIGS. 7 to 12 illustrate a container 102 according to a second embodiment of the invention.

The container 102 of this embodiment is similar to that of the first embodiment and only the differences compared to that embodiment will be described in detail.

In this regard, the only difference between the two embodiments is in relation to the adhesive tab 80. In this embodiment, rather than having a tab 80 which extends to the distal edge 74 of the second locking flap panel 68, the adhesive tab 180 in this embodiment is defined in the second locking flap 68 at a spacing from the distal edge 74 thereof to provide a continuous distal locking edge 176. The adhesive tab 180 is defined by a pair of L-shaped side cuts 182 and a transverse cut 184. The L-shaped side cuts 18 to facilitate flexing of the second locking flap panel 66 away from the first locking flap panel 58 in the same manner as the first embodiment.

The steps in the erection and opening of the container 102 are the same as those as in a direction of the first container 2 and need not, therefore, be described in detail. As in the earlier embodiment, an adhesive will be applied in region 188 between the adhesive tab 180 and the underlying first locking flap panel 58 to attach the second locking flap panel 66 to the first locking flap panel 58.

FIGS. 11 to 15 illustrate a container 202 according to a third embodiment of the invention.

The container 202 of this embodiment is similar to that of the first and second embodiments and only the differences compared to those embodiments will be described in detail.

In this embodiment, rather than having an adhesive tab defined in the second locking flap panel, an adhesive tab 280 is hingedly attached to the distal edge 274 of the second locking flap panel 66 about an adhesive tab fold line 282.

Figure 13:
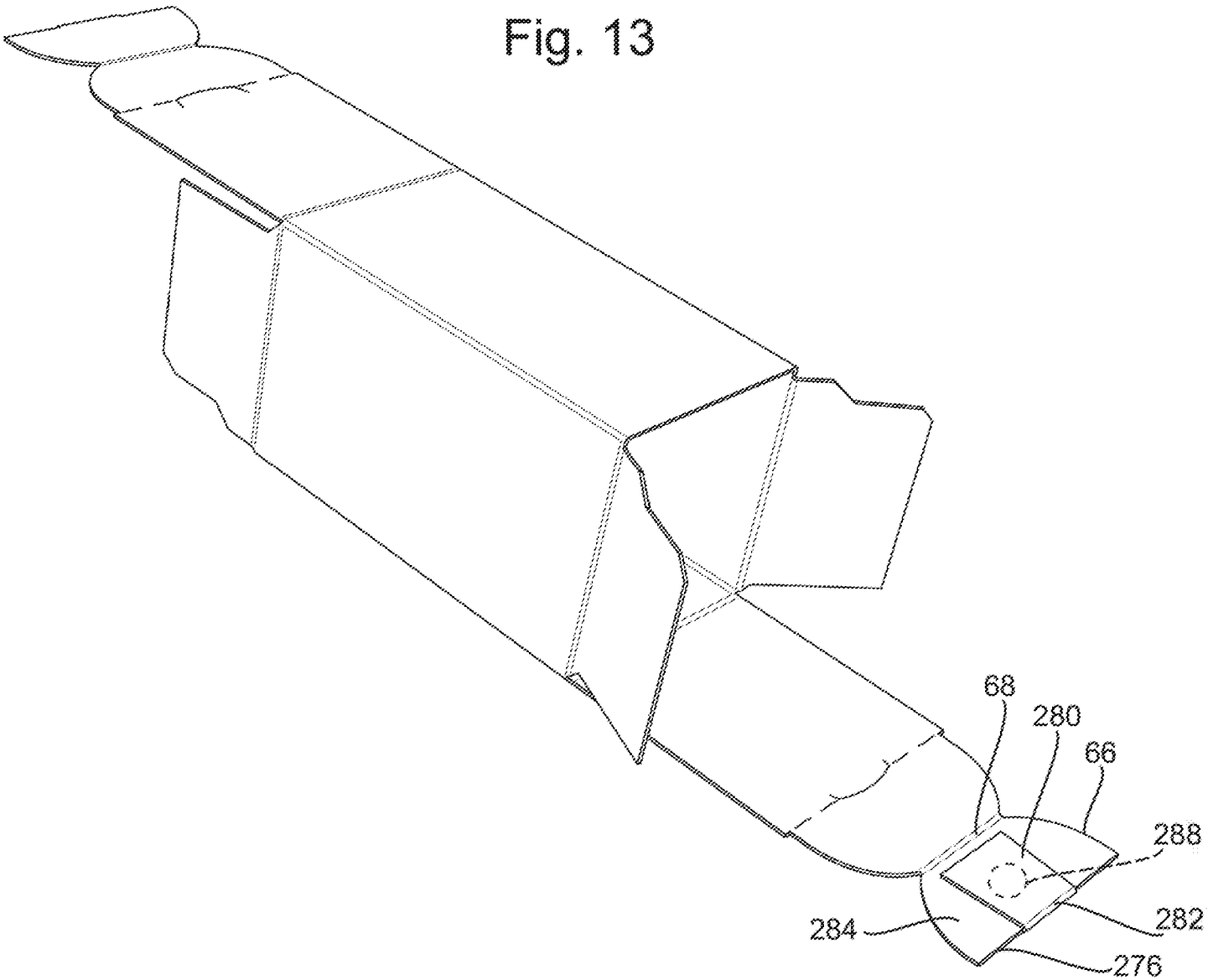
FIG. 13 shows an intermediate stage in the erection of the container of FIG. 11.
Figure 14:
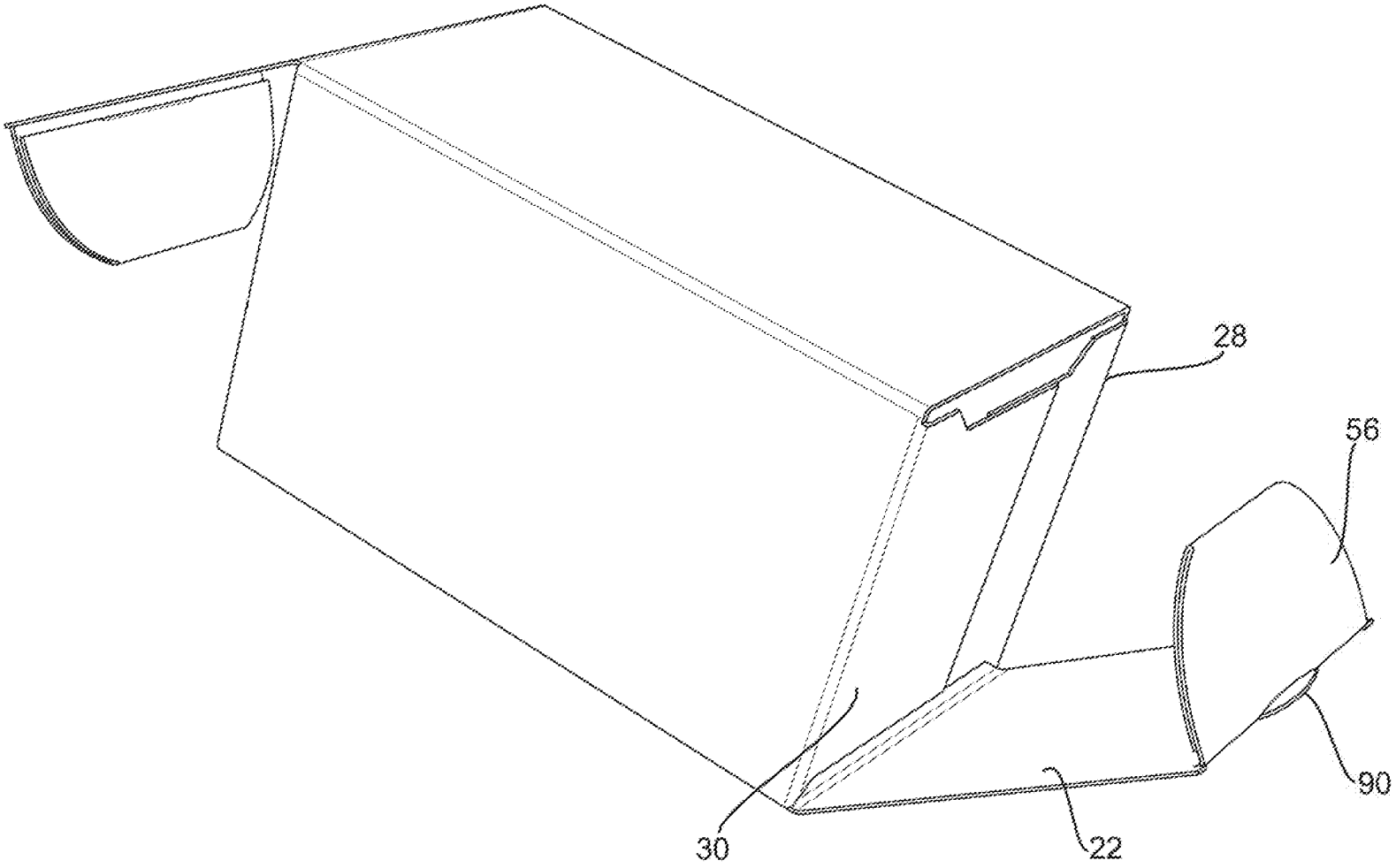
FIG. 14 shows a further stage in the erection of the container of FIG. 11.

The erection of the container 202 of this embodiment is generally similar to that of the erection of the containers 2, 102 of the earlier embodiments. However, as illustrated in FIG. 13, the adhesive tab 280 is folded inwardly about the adhesive tab fold line 282 to overlie the adjacent surface 284 of the second locking flap panel 66. An adhesive may then be applied to the adhesive tab 280 in an adhesive region 288 and the second locking flap panel 66 then folded about the locking flap hinge line 68 so as to sandwich the adhesive tab 280 being sandwiched between the first and second closure flap panels 58, 66 and adhere the adhesive tab 280 (and thus indirectly the second locking flap panel 66) to the first closure flap panel 58. In some embodiments, as a preliminary step, an adhesive may be applied between the adhesive tab 280 and the second locking flap panel 66.

Figure 15:
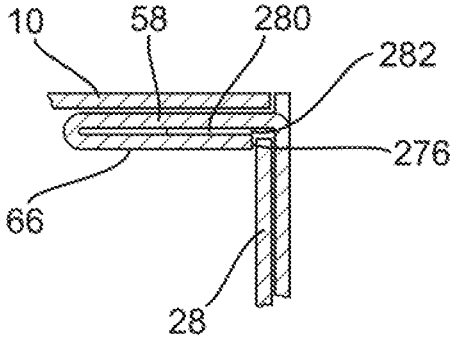
FIG. 15 shows a sectional view along line XV-XV of FIG. 11.
Figure 12:
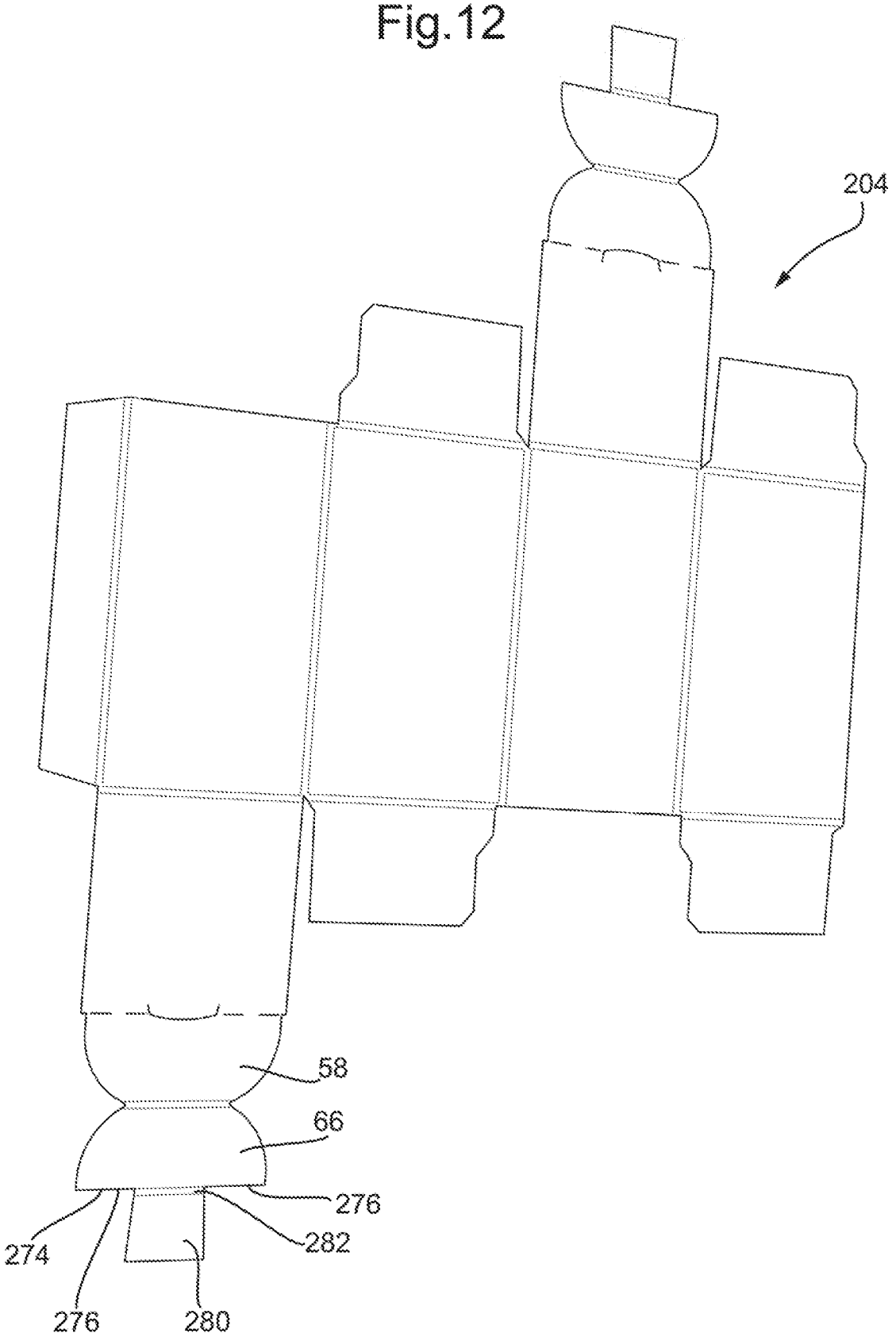
FIG. 12 shows a blank for making the container of FIG. 11.

The adhesive tab fold line 282 forms part of a continuous locking edge 276 defined at the distal edge of the second locking flap panel 66. The adhesive tab 280 creates a stand-off between the first and second locking flap panels 58, 66 to facilitate engagement of the locking edge 276 behind the closure flaps 28, 30, as shown in FIG. 15.

In this embodiment, the adhesive tab 280 extends only across a portion of the distal edge 274 of the second locking flap panel 66, in a central region thereof. In other embodiments, the adhesive 280 extend across the entire distal edge 274.

Figure 16:
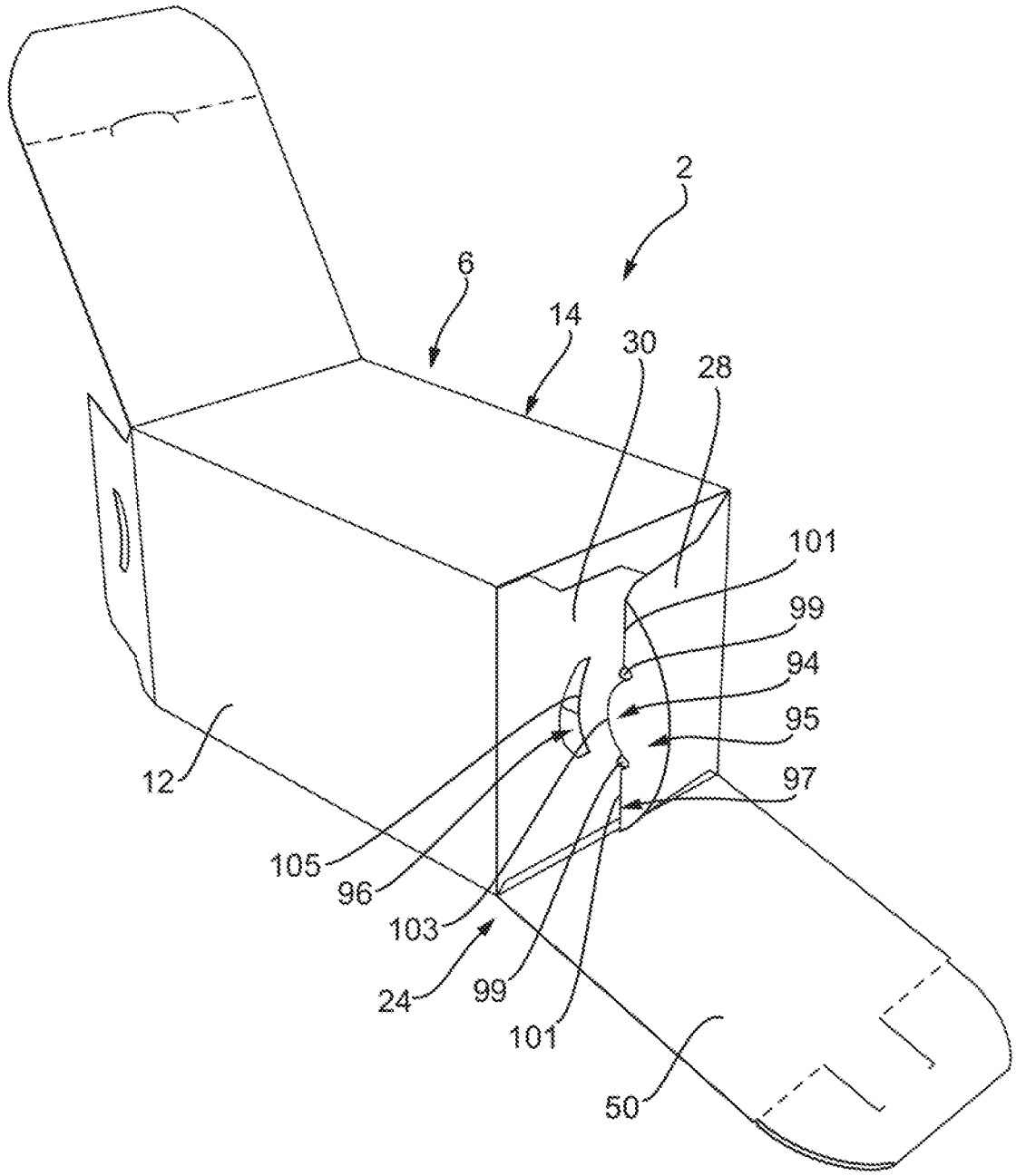
FIG. 16 shows a perspective view of another embodiment of container in accordance with the present invention having refastenable re-closure features associated with the ends thereof, showing the ends in an open configuration.
Figure 17:
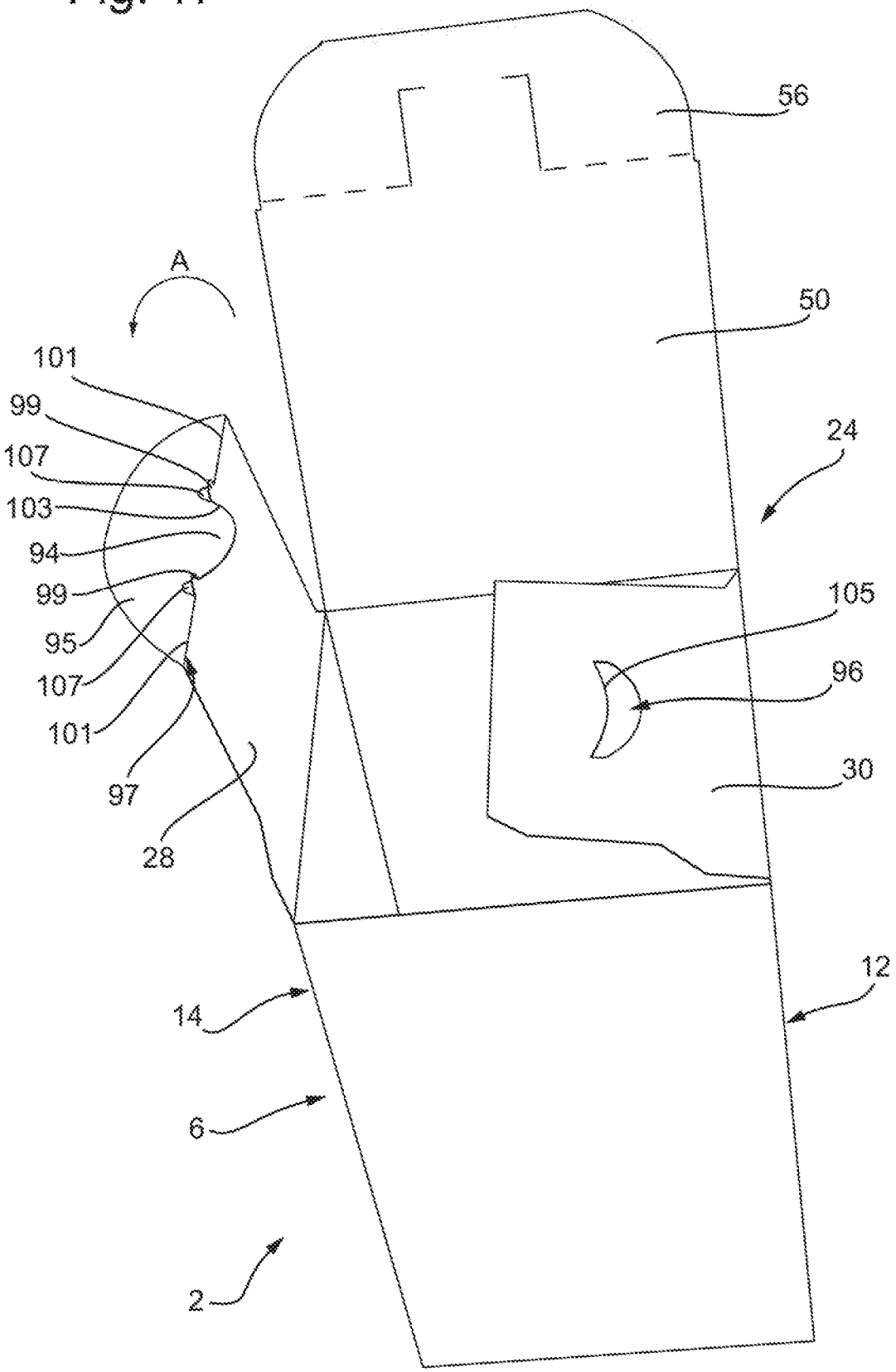
FIG. 17 is another perspective view of the container shown in FIG. 16 with its ends in an open configuration.
Figure 18:
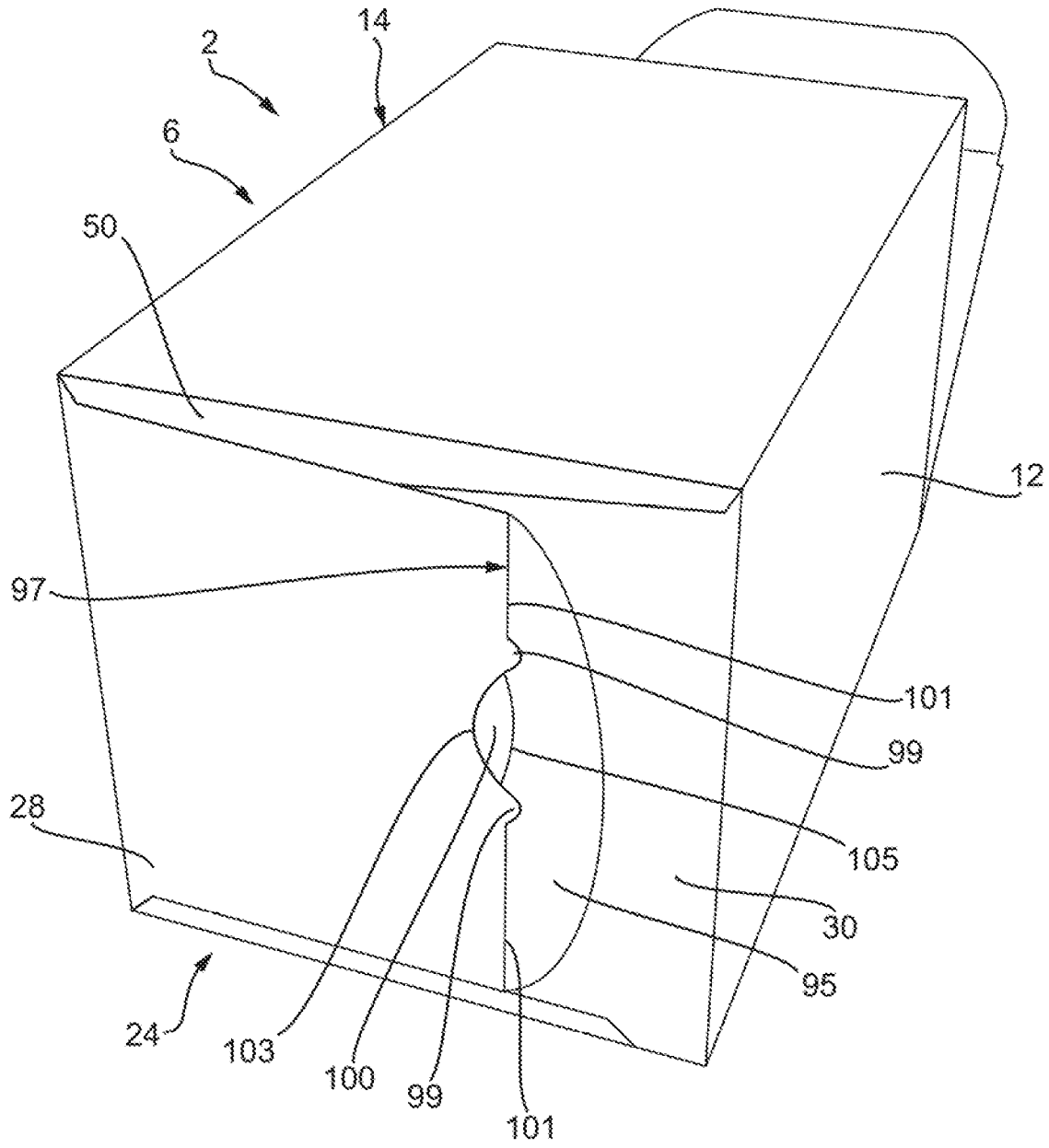
FIG. 18 shows the container of FIGS. 16 and 17 with the refastenable re-closure at one end in a closed configuration.

FIGS. 16, 17 and 18 illustrate a further embodiment of a container 2 in accordance with the invention incorporating a refastenable re-closure feature for closing an end of the container 2 having a lid as earlier described. This refastenable re-closure feature is illustrated as being incorporated in a container 2 in accordance with the first embodiment of the invention, wherein the adhesive locking tab 80 is defined in the second locking flap panel 66 between a pair of cut lines 82 which extend to the distal edge 74 thereof. However, such a refastenable re-closure feature may be incorporated with any of the other embodiments described herein i.e. the embodiments of FIGS. 7 to 12 or 11 to 15, at one or both ends thereof.

While described with reference to the first end 24 of the container body 6, such a refastenable re-closure feature may alternatively or additionally be arranged at the second end 24' of the container body 6 for closing the second end. The embodiment illustrated in FIGS. 16-18 includes a refastenable re-closure feature at both ends.

FIGS. 16 and 17 show the end 24 of the container in an open configuration, illustrating the components of the refastenable re-closure feature. FIG. 18 illustrates the container 2 with the end 24 in its closed configuration once the container 2 has been initially opened, resulting in separation of the locking flap 56 from the lid panel 50 about the frangible line of weakness 64. FIG. 18 illustrates the manner in which the components of the refastenable re-closure feature releasably interlock the first and second closure flaps 28, 30 together, with the lid panel 50 therebeneath.

The refastenable re-closure feature includes a locking tab 94 associated with the first closure flap 28 and an opening 96, illustrated as a slot, in the second closure flap 30. It will be appreciated that alternatively the locking tab 94 may be associated with the second closure flap 30 and the opening 96 may be in the first closure flap 28. The opening 96 is configured to receive the locking tab 94 and releasably interlock therewith in a closed configuration of the end of the container 2. The locking tab 94 is retained by an edge 105 of the opening, which acts as a locking edge. Of course, the opening 96 need not be in the form of a slot, provided that it is able to function in this manner.

The first closure flap 28 includes a re-closure panel 95 hingedly attached to a distal edge 97 of the first closure flap 28 about a foldline 101. The locking tab 94 is formed by a cutline which extends from the re-closure panel 95 across the foldline 101 into the first closure flap 28. The free edge of the locking tab 94 formed in this manner is denoted 103. When the re-closure panel 95 is rotated about the foldline 101 (e.g. up to 90°) to a position as shown in FIGS. 16 and 17, the locking tab 94 moves with the re-closure panel 95 and thus pivots relative to the first closure flap 28 so as to project from the first closure flap 28. The direction of rotation will be in an anticlockwise direction from the viewpoint of FIG. 17 in the direction of the arrow A. This enables the locking tab 94 to be inserted into the opening 96 when the first closure flap 28 is folded over the second closure flap 30. When the re-closure panel 95 is released, it will return to a position as shown in FIG. 18, in a plane closer to that of the first closure flap 28. In this closed configuration of the end 24 of the container 2, the first closure flap 28 is substantially flat and overlies the second closure flap 30, with the locking tab 94 retained in the opening 96.

A pair of stubs 99 may be defined on either side of the locking tab 94, between the edge of the locking tab 94 and the portion of the foldline 101 on the respective side of the locking tab 94. This may be achieved using a suitable configuration of the cutline which defines the locking tab 94. These stubs 99 extend from the first closure flap 28 across the foldline 101 into the re-closure panel 95, and will project from the distal end 97 of the first closure flap 28 when the re-closure panel 95 is rotated about the foldline 101 during closing of the end 24 of the container 2, to define a corresponding space 107 between the edge of the locking tab 94 and the end of the portion of the foldline 101 on the respective side of the locking tab 94. The stubs extend in the direction opposite to the locking tab 95 relative to the foldline 101 i.e. distally rather than proximally. The presence of the stubs may mitigate stress concentration around the joins between the locking tab 94 and the foldline 101, reducing the likelihood of a tear developing in use. The stubs have rounded ends to assist in this function. The stubs may also help to facilitate rotation of the re-closure panel 95 about the foldline 101.

The opening 96 may be of an arcuate shape as illustrated in FIGS. 16 and 17, or any other suitable shape, such as a rectangular or crescent shape. The locking tab 94 may have a semi-circular shape, as illustrated, or any other suitable shape, such as rectangular or triangular.

The opening 96 may be located in any location on the second closure flap 30, provided it is located relative to the locking tab 94 such that the locking tab 94 may be inserted into the opening 96 in the manner described above when the first closure flap 28 is located over the second closure flap 30 during closing of the end 24 of the container. For example, in the illustrated embodiments, the closure flaps 28, 30 do not each extend the whole way between a pair of opposed side wall panels 12, 14, and the opening 96 is in the middle of the second closure flap 30.

However, depending e.g. upon the relative extents of the first and second closure flaps 28, 30 and/or the first closure flap 28 and the re-closure panel 95, the position of the opening may vary.

The re-closure feature enables the container 2 to be closed even after the frangible line of weakness 64 is broken and the locking flap 56 can no longer lock the lid panel 50 in position. The user will fold the lid panel 50 over the end 24 of the container 2, and then fold the second closure flap 30 over the lid panel 50, and the first closure flap 28 over the second closure flap 30, rotating the re-closure panel 95 about the foldline 101 as illustrated in FIGS. 16 and 17 to cause the locking tab 94 to project relative to the first closure flap 28 for insertion in the opening 96 in the second closure flap 30 to thereby releasably lock the first and second closure flaps 28, 30 together. In this way, as shown in FIG. 18, the lid panel 50 is held behind the interlocked closure flaps 28, 30, keeping the container in a closed, compact configuration. In FIG. 18, the region 100 of the second closure panel 30 distal to the opening 96 under which the locking tab 94 has been inserted, is visible. It will remain evident that the container 2 has already been opened; however the user will be able to re-close the container 2 to keep any contents therein. When desired, the user may disengage the locking tab 94 from the opening 96 to open the end 24 of the container once more 24 to gain access to the contents thereof. The refastenable closure feature may be used to repeatedly refastenably close the end 24 of the container.

The construction and operation of the refastenable closure at the other end 24' of the container shown in the embodiment of FIGS. 16-18 is identical to that described in relation to the end 24, and may include any or all of the features described in relation to the closure at the end 24. As mentioned previously, a refastenable closure may be provided at either one or both of the ends of the container, and need not be present at both ends as illustrated in the embodiment shown.

In accordance with any of the embodiments of the invention, and regardless of to which embodiment of the container the refastenable re-closure feature is applied, it is envisaged that other forms of refastenable closure may be used, which need not involve a locking tab being defined in the manner of the illustrated embodiment, extending from a re-closure panel 95 associated with the first closure flap 28. For example, a locking tab may project directly from a distal end of the first closure flap 28, or be defined within the first closure flap 28 in any suitable manner. However, other forms of refastenable closure need not necessarily involve a cooperating tab and opening associated with ones of the first and second closure flaps. Similar alternative arrangements are equally applicable if, in the case of cooperating tab and opening type arrangements, the second closure flap 30 has the tab and the first closure flap 28 the opening, or, in any type of arrangement, if the refastenable closure is associated with the other end of the container.

It will be understood that the above description is of a number of exemplary embodiments only and that modifications may be made to the embodiments without departing from the scope of the invention. For example, while the containers described herein have tamper evident closures in accordance with the invention provided at both ends of the container, such a closure need only be provided at one end in certain containers. For example, in certain embodiments, where access to the contents of the container is required thorough only one end of the container, the other end of the container may be glued closed.

The invention claimed is:

1. A tamper evident container made from cardboard, paperboard or other lightweight foldable sheet material comprising:

(a) a container body comprising a first pair of opposed side wall panels and a second pair of side wall panels, the side wall panels being hingedly attached to each other about respective side wall fold lines;

(b) a lid hingedly attached to one side wall panel of the first pair of opposed side wall panels about a lid fold line;

(c) first and second closure flaps, each hingedly attached to a respective one of the second pair of opposed wall panels about respective closure flap fold lines so as to define respective locking slots between a side edge of the respective closure flaps and the other side wall panel of the first pair of side wall panels;

the lid comprising:

(I) a lid panel hingedly attached at a proximal edge to the one side wall panel of the first pair of side wall panels about the lid fold line; and (II) a locking flap comprising a first locking flap panel hingedly attached at a proximal edge to a distal edge of the lid panel about a frangible line of weakness and a second locking flap panel hingedly attached at a proximal edge to a distal edge of the first locking flap panel about a locking flap fold line and folded about the locking flap fold line so as to lie behind and in a face to face relationship with the first locking flap panel, wherein the second locking flap panel comprises:

(1) a pair of cut lines which extend to a distal edge of the second locking flap panel so as to define an adhesive tab therebetween; and (2) a pair of locking edges on the distal edge on either side of the adhesive tab, and the second locking flap panel is adhesively attached to the first locking flap panel by the adhesive tab to prevent the second locking flap unfolding relative thereto; and wherein the locking flap is insertable into the locking slots such that the pair of locking edges of the second locking flap panel engages behind the side edges of the closure flaps so as to lock the lid in position.

2. A tamper evident container as claimed in claim 1, wherein the adhesive tab is formed in a central region of the distal edge of the second locking flap panel.

3. The tamper evident container as claimed in claim 1, wherein the adhesive tab extends across only a portion of the distal edge of the second closure flap panel.

4. The tamper evident container as claimed in claim 1, wherein the side edges of the closure flaps are ramped so as to define the locking slots with the other side wall panel of the first pair of side wall panels only at a proximal end region of the closure flaps thereof adjacent the respective side wall panel.

5. The tamper evident container as claimed in claim 1, wherein the frangible line of weakness comprises perforations or wherein the frangible line of weakness comprises a partial thickness cut.

6. The tamper evident container as claimed in claim 1, further comprising an opening tab defined in the lid panel at the frangible line of weakness, and interrupting the line of weakness.

7. The tamper evident container as claimed in claim 1, further comprising a refastenable re-closure arrangement that includes cooperating parts associated with each of the first and second closure flaps for releasably interlocking the first and second closure flaps together.

8. The tamper evident container as claimed in claim 7, wherein the cooperating parts comprise:

a locking tab associated with one of the first and second closure flaps; and an opening associated with the other of the first and second closure flaps, wherein the opening is configured to receive the locking tab for releasably interlocking the first and second closure flaps together.

9. The tamper evident container as claimed in claim 8, further comprising a re-closure panel hingedly attached along a fold line to a distal edge of the one of the first and second closure flaps having the locking tab associated therewith, wherein the locking tab interrupts the foldline.

10. The tamper evident container as claimed in claim 9, wherein the locking tab is formed by a cutline which extends from the re-closure panel across the foldline into the one of the first and second closure flaps.

11. The tamper evident container as claimed in claim 8, wherein a pair of stubs are defined on either side of the locking tab between the edge of the locking tab and the portion of the foldline on the respective side of the locking tab, optionally wherein the stubs have rounded ends.

12. A tamper evident container made from cardboard, paperboard or other lightweight foldable sheet material comprising:

(a) a container body comprising a first pair of opposed side wall panels and a second pair of side wall panels, the side wall panels being hingedly attached to each other about respective side wall fold lines;

(b) a lid hingedly attached to one side wall panel of the first pair of opposed side wall panels about a lid fold line;

(c) first and second closure flaps, each hingedly attached to a respective one of the second pair of opposed wall panels about respective closure flap fold lines so as to define respective locking slots between a side edge of the respective closure flaps and the other side wall panel of the first pair of side wall panels;

the lid comprising:

(I) a lid panel hingedly attached at a proximal edge to the one side wall panel of the first pair of side wall panels about the lid fold line; and (II) a locking flap comprising a first locking flap panel hingedly attached at a proximal edge to a distal edge of the lid panel about a frangible line of weakness and a second locking flap panel hingedly attached at a proximal edge to a distal edge of the first locking flap panel about a locking flap fold line and folded about the locking flap fold line so as to lie behind and in a face to face relationship with the first locking flap panel, wherein the second locking flap panel comprises a pair of cut lines so as to define an adhesive tab therebetween that is positioned at a spacing from a distal edge of the second locking flap and the second locking flap panel is adhesively attached to the first locking flap panel by the adhesive tab to prevent the second locking flap unfolding relative thereto;

wherein a distal end of the second locking flap panel comprises at least one free edge forming a locking edge, and wherein the locking flap is insertable into the locking slots such that the locking edge of the second locking flap panel engages behind the side edges of the closure flaps so as to lock the lid in position.

13. The tamper evident container as claimed in claim 12, further comprising an opening tab defined in the lid panel at the frangible line of weakness, and interrupting the line of weakness.

14. The tamper evident container as claimed in claim 12, further comprising a refastenable re-closure arrangement that includes cooperating parts associated with each of the first and second closure flaps for releasably interlocking the first and second closure flaps together.

15. A tamper evident container made from cardboard, paperboard or other lightweight foldable sheet material comprising:

(a) a container body comprising a first pair of opposed side wall panels and a second pair of side wall panels, the side wall panels being hingedly attached to each other about respective side wall fold lines;

(b) a lid hingedly attached to one side wall panel of the first pair of opposed side wall panels about a lid fold line;

(c) first and second closure flaps, each hingedly attached to a respective one of the second pair of opposed wall panels about respective closure flap fold lines so as to define respective locking slots between a side edge of the respective closure flaps and the other side wall panel of the first pair of side wall panels;

the lid comprising:

(I) a lid panel hingedly attached at a proximal edge to the one side wall panel of the first pair of side wall panels about the lid fold line, and (II) a locking flap comprising a first locking flap panel hingedly attached at a proximal edge to a distal edge of the lid panel about a frangible line of weakness and a second locking flap panel hingedly attached at a proximal edge to a distal edge of the first locking flap panel about a locking flap fold line and folded about the locking flap fold line so as to lie behind and in a face to face relationship with the first locking flap panel, wherein the second locking flap panel is adhesively attached to the first locking flap panel through an adhesive tab to prevent the second locking flap unfolding relative thereto;

wherein the adhesive tab is hingedly attached to a distal edge of the second closure flap panel about an adhesive tab fold line, the adhesive tab extends across only a portion of the distal edge of the second closure flap panel, and the adhesive tab is sandwiched between the first and the second closure flap panels and adhered at least to the first closure flap panel;

wherein a distal end of the second locking flap panel comprises at least one free edge forming a locking edge; and wherein the locking flap is insertable into the locking slots such that the locking edge of the second locking flap panel engages behind the side edges of the closure flaps so as to lock the lid in position.

16. The tamper evident container as claimed in claim 15, further comprising an opening tab defined in the lid panel at the frangible line of weakness, and interrupting the line of weakness.

* * * * *